United States Patent [19]

Van de Walker

[11] 4,370,953

[45] Feb. 1, 1983

[54] CYLINDER TWO STROKE ENGINE WITH TORSIONAL RESONANCE CONTROL

[75] Inventor: Peter G. Van de Walker, Lake Villa, Ill.

[73] Assignee: Outboard Marine Corporation, Waukegan, Ill.

[21] Appl. No.: 146,257

[22] Filed: May 5, 1980

[51] Int. Cl.[3] ..... F02B 75/22

[52] U.S. Cl. ..... 123/55 VS; 123/55 R; 123/73 R

[58] Field of Search ..... 123/55 R, 55 VS, 73 R, 123/73 A

[56] References Cited

U.S. PATENT DOCUMENTS

| | | | |
|---|---|---|---|
| Re. 15,019 | 1/1921 | Landgraf | 123/55 VS |
| 1,288,970 | 11/1918 | Thomas | 123/55 VS |
| 2,632,340 | 3/1953 | Dolza et al. | 123/55 VS |
| 3,166,054 | 1/1965 | Conover | 123/55 VS |

*Primary Examiner*—Wendell E. Burns

*Attorney, Agent, or Firm*—Michael, Best & Friedrich

[57] ABSTRACT

The two stroke engine includes a V engine block having first and second cylinder banks each with first, second, and third cylinders, which banks are located at a bank angle within the range of from about 60° to about 90°, a cylinder firing order wherein corresponding cylinders from alternate banks are successively fired, a cylinder firing interval constituted by a repetitious cycle of crankshaft angles between firings including a first firing interval angle followed by a second firing interval angle, wherein the sum of the first and second firing interval angles equals about 120°, and a crankshaft having first, second, and third crankpins respectively associated with the first, second and third cylinders of both of the banks, each of the crankpins being spaced from each other at an angle of about 120° and each of the crankpins including a first portion associated with one of the cylinders in the first bank and a second portion associated with one of the cylinders in the second bank and located in axially adjacent relation to the first portion at a splay angle from the first portion, which splay angle is approximately equal to the absolute value of the difference between the first firing interval angle and the bank angle.

11 Claims, 6 Drawing Figures

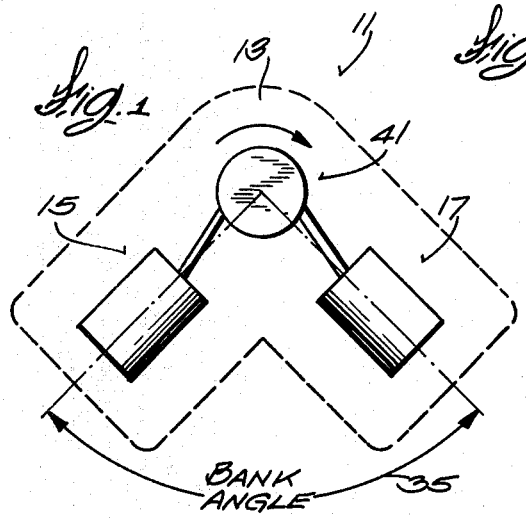
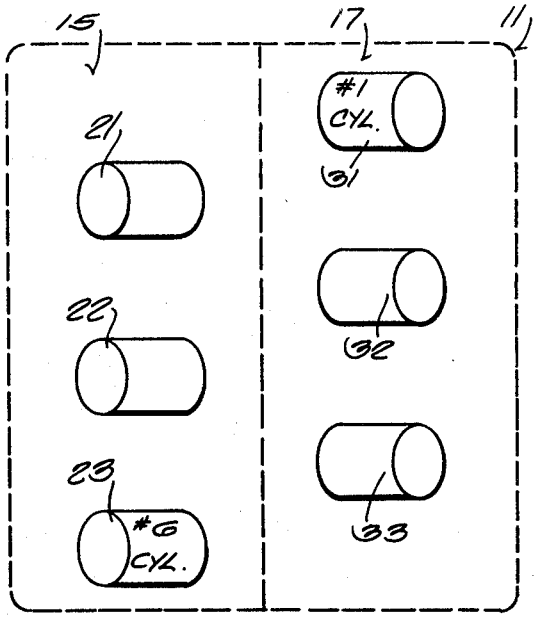
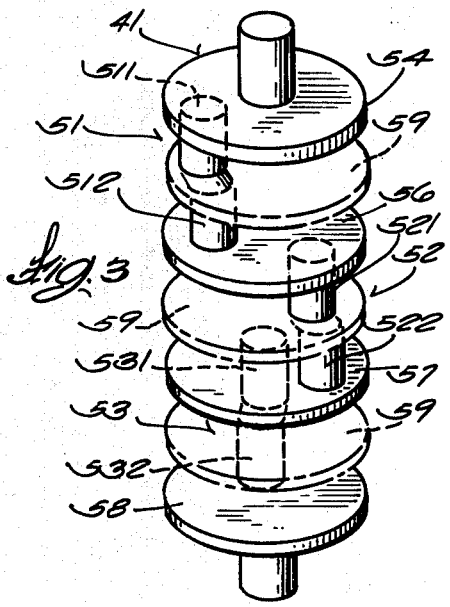
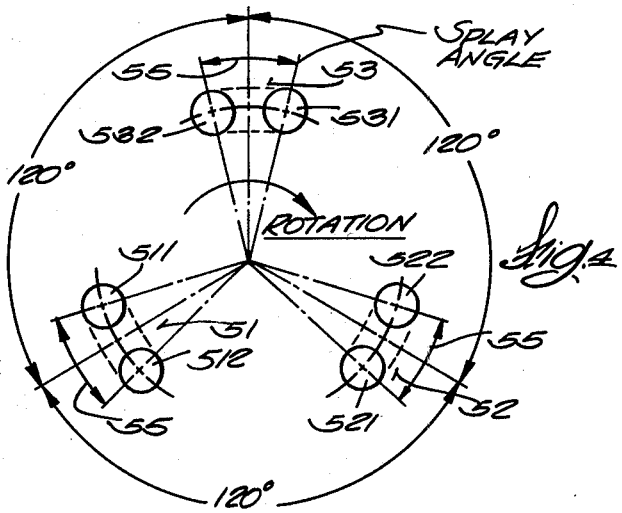
Fig. 6
| CRANKSHAFT SPLAY ANGLE | | |
|---|---|---|
| 60° BANK ANGLE | 75° BANK ANGLE | 90° BANK ANGLE |
| 60°-60°-60°-60°-60°-60° FIRING INTERVAL | | |
| 0° | +15° | +30° |
Fig. 5
| CRANKSHAFT SPLAY ANGLE | | |
|---|---|---|
| 60° BANK ANGLE | 75° BANK ANGLE | 90° BANK ANGLE |
| 75°-45°-75°-45°-75°-45° FIRING INTERVAL | | |
| -15° | 0° | +15° |
| 70°-50°-70°-50°-70°-50° FIRING INTERVAL | | |
| -10° | +5° | +20° |
| 80°-40°-80°-40°-80°-40° FIRING INTERVAL | | |
| -20° | -5° | +10° |

CYLINDER TWO STROKE ENGINE WITH TORSIONAL RESONANCE CONTROL

BACKGROUND OF THE INVENTION

The invention relates generally to internal combustion engines and, in particular, to two stroke, six cylinder V-type engines. Still more particularly, the invention relates to minimizing excessive reinforcement of the amplitude of crankshaft torsional vibration which can accompany operation of such engines, particularly when operated at relatively high speeds, i.e., speeds above about 3,000 rpm.

Such excessive reinforcement of the amplitude of the crankshaft torsional vibration can be detrimental to an engine operating at relatively high speeds with respect to the production of undesirable noise, with respect to crankshaft bearing failure, and/or with respect to crankshaft or flywheel failure by reason of fatigue.

SUMMARY OF THE INVENTION

The invention provides a two stroke engine comprising a V engine block having first and second cylinder banks each with first, second, and third cylinders, which banks are located at a bank angle within the range of from about 60° to about 90°. The engine also includes means for establishing a cylinder firing order wherein one of the three cylinders of the first bank is first fired, followed by firing of the same one of the three cylinders of the second bank, followed by firing of one of the remaining two of the three cylinders of the first bank, followed by firing of the same one of the remaining two of the three cylinders of the second bank, followed by firing of the remaining one of the three cylinders of the first bank, and followed by firing of the remaining one of the three cylinders of the second bank.

The engine further includes means for establishing a cylinder firing interval constituted by a repetitious cycle of crankshaft displacement angles between firings including a first firing interval angle followed by a second firing interval angle, wherein the sum of the first and second firing interval angles equals about 120°. In addition, the engine includes a crankshaft having first, second, and third crankpins respectively associated with the first, second and third cylinders of both of the banks, each of which crankpins is spaced from each other at an angle of about 120° and each of which crankpins includes a first portion associated with one of the cylinders in the first bank and a second portion associated with one of the cylinders in the second bank and located in axially adjacent relation to the first portion at a splay angle from the first portion, which splay angle is approximately equal to the absolute value of the difference between the first firing interval angle and the bank angle.

In one embodiment in accordance with the invention, the first firing interval angle is within a range of about 70° to about 80°.

In one embodiment in accordance with the invention, the first and second firing interval angles are each about 60°.

One of the principal features of the invention is reduction in crankshaft torsional resonance in a two stroke, six cylinder internal combustion engine.

Another of the principal features of the invention is reduction in crankshaft torsional resonance in a two stroke, six cylinder, V-type internal combustion engine having a first firing interval angle of 75°±5° and a second firing interval angle of 45°±5°.

Another of the principal features of the invention is reduction in crankshaft torsional resonance in a two stroke, six cylinder, V-type internal combustion engine having a generally uniform 60° firing interval angle.

Other features and advantages of the invention will become known by reference to the following description, appended claims, and accompanying drawings.

IN THE DRAWINGS

FIG. 1 is a schematic top view of a six cylinder engine embodying various of the features of the invention.

FIG. 2 is a schematic rear view of the engine shown in FIG. 1.

FIG. 3 is a perspective view of a crankshaft incorporated in the engine shown in FIG. 1.

FIG. 4 is a schematic view of the cranks incorporated in the crankshaft shown in FIG. 3.

FIG. 5 is a chart illustrating various cooperating arrangements of bank angles, firing intervals, and splay angles intended to reduce torsional resonance in two stroke six cylinder V engines using a first firing interval angle of 75°±5° and a second firing interval angle of 45°±5°.

FIG. 6 is a chart illustrating various cooperating arrangements of bank angles and splay angles intended to reduce crankshaft torsional resonance in a two stroke six cylinder V engine having a generally uniform firing interval angle of about 60°.

Before explaining at least one embodiment of the invention in detail, it is to be understood that the invention is not limited in its application to the details of the construction and arrangements of parts set forth in the following general description or illustrated in the accompanying drawings, since the invention is capable of other embodiments and of being practiced or carried out in various ways. Also, it is to be understood that the phraseology or terminology employed herein is for the purpose of description and not of limitation.

GENERAL DESCRIPTION

Illustrated schematically in the drawings is one embodiment of a family of two stroke internal combustion engines 11 which include a block 13 of V shape, having first and second cylinder banks 15 and 17 each including first, second and third cylinders 21, 22 and 23, and 31, 32 and 33. It is noted that the first, second and third cylinders of each bank are numbered beginning at the same bank ends. The first and second banks 15 and 17 can be disposed at a bank angle 35 to each other of from about 60° to about 90°. In addition, and in general, it is contemplated that the six cylinder engines referred to herein have a displacement in the range of from about 100 to about 200 cubic inches.

The engine 11 also includes a crankshaft 41 which is suitably supported by bearings (not shown) mounted in the block 13, and which, as is conventional, includes first, second and third crankpins 51, 52 and 53 which are supported between first, second, third, and fourth crank discs 54, 56, 57 and 58 respectively, and which, in general, are angularly spaced from each other at an angle of about 120°, with the first crankpin 51 including first and second portions 511 and 512 respectively associated with connecting rods (not shown) respectively connected to the first cylinders 21 and 31 of the first and second cylinder banks 15 and 17, with the second crankpin 52 including first and second portions 521 and 522 respectively associated with connecting rods (not shown) respectively associated with the second cylinders 22 and 32 of the first and second cylinder banks 15 and 17, and with the third crankpin 53 including first and second portions 531 and 532 respectively associated with connecting rods (not shown) respectively associated with the third cylinders 23 and 33 of the first and second cylinder banks 15 and 17. The first and second crankpin portions of all of the crankpins 51, 52 and 53 are angularly offset from each other at a uniform splay angle 55 which will hereinafter be referred to in greater detail. If desired, as shown in dotted outline in FIG. 3 additional crank discs 59 can be provided between the first and second crank pin portions of the first, second, and third crank pins 51, 52 and 53. In general, it is contemplated that the crankshafts referred to herein have a torsional natural frequency in a range of from about 300 to about 400 cycles per second.

The engine 11 is also equipped with means including an ignition system (not shown) which serves to fire the cylinders 21, 22, 23, 31, 32, 33 in an order such that one of the three cylinders 31, 32 and 33 of the second cylinder bank 17 is first fired, as for instance, the cylinder 31, followed by firing of the corresponding cylinder in the first cylinder bank 15, as for instance, the cylinder 21, followed by firing of one of the two remaining cylinders 32 and 33 in the second cylinder bank 17, followed by firing of the corresponding one of the two remaining cylinders 22 and 23 of the first cylinder bank 15, followed by firing of the one remaining cylinder of the second cylinder bank 17, and followed by firing of the one remaining cylinder of the first cylinder bank 15. Thus, firing orders of 31-21-32-22-33-23 or 31-21-33-23-32-22 are possible.

The engine 11 is also equipped with means including the previously mentioned ignition system (not shown) for establishing a cylinder firing interval constituted by a repetitious cycle of crankshaft angle displacements occurring between firings, such that a first firing interval angle occurs, and then a second firing interval angle, and then the first firing interval angle, and then the second firing interval angle, etc., it being understood that the sum of the first and second angles is equal to about 120°.

In some embodiments the first firing interval angle is longer than the second firing interval angle, and the first firing interval angle can vary from about 70° to about 80° depending upon the bank angle. In these embodiments, in order to avoid undesirable reinforcement of crankshaft torsional vibration amplitude, the previously referred to splay angle 55, the firing interval, and the bank angle 35 are controlled so as to avoid or at least to minimize the undesirable effect of excessive crankshaft torsional vibration amplitude reinforcement over a wide speed range, for instance, over a speed range of from about 2,000 rpm to about 9,000 rpm. In this last regard, depending upon the desired bank angle and firing interval, the splay angle 55 is arranged such that it is equal to the absolute value of the difference between the first firing interval angle and the bank angle 35. In this last regard, a plus splay angle indicates displacement of the second crankpin portion from the first portion in the direction of crankshaft rotation and a minus splay angle indicates displacement in the direction opposite to the direction of crankshaft rotation.

Thus, as indicated in FIG. 5, in an engine having a 75–45 firing interval, when the bank angle is 60° the splay angle is minus 15°. When the bank angle is 75°, the splay angle is zero, and when the bank angle is 90°, the splay angle is plus 15°.

In an engine having a 70-50 firing interval, when the bank angle is 60°, the splay angle is minus 10°, when the bank angle is 75°, the splay angle is 5°, and when the bank angle is 90°, the splay angle is 20°.

In an engine having an 80-40 firing interval, when the bank angle is 60°, the splay angle is minus 20°, when the bank angle is 75°, the splay angle is minus 5°, and when the bank angle is 90°, the splay angle is 10°.

It is believed that the 75-45 firing interval is the most desirable. However, the range between 80-40 and 70-50 firing intervals is believed to be workable without serious degradation of results. It is further possible that crankshaft natural frequency and engine speed range considerations might favor a deviation from the preferred 75-45 firing interval arrangement.

In other embodiments, the engine 11 is equipped with means including an ignition system (not shown) for establishing a generally uniform cylinder firing interval angle of about 60°, i.e., a crankshaft angular displacement of about 60° intermediate each firing. In these embodiments, in order to avoid undesirable reinforcement of crankshaft torsional vibration amplitude, the previously referred to splay angle 55, and the bank angle 35 are controlled so as to avoid or at least to minimize the undesirable effect of excessive crankshaft torsional vibration amplitude reinforcement occurring within a high speed range of from about 6,000 rpm to about 9,000 rpm. In this last regard, and keeping in mind that a uniform 60° firing interval angle is employed, and depending upon the desired bank angle, the splay angle 55 is arranged such that it is equal to the absolute value of the difference between the firing interval angle and the bank angle 35. In this last regard, a plus splay angle indicates displacement of the second crankpin portion from the first portion in the direction of crankshaft rotation and a minus splay angle indicates displacement in the direction opposite to the direction of crankshaft rotation. Thus, as indicated in FIG. 6, in an engine having a uniform 60° firing interval, when the bank angle is 60° the splay angle is zero. When the bank angle is 75°, the splay angle is plus 15°, and when the bank angle is 90°, the splay angle is plus 30°.

Various of the features of the invention are set forth in the following claims.

I claim:

1. A two stroke engine comprising a V engine block having first and second cylinder banks each with first, second, and third cylinders, said banks being located at a bank angle within the range of from about 60° to about 90°, means for establishing a cylinder firing order wherein one of said three cylinders of said first bank is first fired, followed by firing of said one of said three cylinders of said second bank, followed by firing of one of the remaining two of said three cylinders of said first bank, followed by firing of said one of the remaining two of said three cylinders of said second bank, followed by firing of the remaining one of said three cylinders of said first bank, and followed by firing of the remaining one of said three cylinders of said second bank, means for establishing a cylinder firing interval constituted by a repetitious cycle of crankshaft angles between firings including a first firing interval angle followed by a second firing interval angle, wherein the sum of said first firing interval angle and said second firing interval angle equals about 120°, and a crankshaft having first, second, and third crankpins respectively associated with said first, second and third cylinders of both said banks, each of said crankpins being spaced from each other at an angle of about 120° and each of said crankpins including a first portion associated with one of said cylinders in said first bank and a second portion associated with one of said cylinders in said second bank and located in axially adjacent relation to said first portion at a splay angle from said first portion, said splay angle being approximately equal to the absolute value of the difference between said first firing interval angle and said bank angle.

2. An engine in accordance with claim 1 wherein said first firing interval angle is larger than said second firing interval angle.

3. An engine in accordance with claim 2 wherein said first firing interval angle is within a range of from about 70° to about 80°.

4. An engine in accordance with claim 3 wherein said first firing interval angle is about 75° and said second firing interval angle is about 45°.

5. An engine in accordance with claim 3 wherein said bank angle is 60° and said splay angle is minus 15°.

6. An engine in accordance with claim 3 wherein said bank angle is 75° and said splay angle is zero.

7. An engine in accordance with claim 3 wherein said bank angle is 90° and said splay angle is plus 15°.

8. An engine in accordance with claim 1 wherein said first and second firing interval angles are each about 60°.

9. An engine in accordance with claim 8 wherein said bank angle is 60° and said splay angle is zero.

10. An engine in accordance with claim 8 wherein said bank angle is 75° and said splay angle is plus 15°.

11. An engine in accordance with claim 8 wherein said bank angle is 90° and said splay angle is plus 30°.

* * * * *

Dedication 4,370,953.—*Peter G. Van de Walker,* Lake Villa, Ill. CYLINDER TWO STROKE ENGINE WITH TORSIONAL RESONANCE CONTROL. Patent dated Feb. 1, 1983. Dedication filed Dec. 23, 1983, by the assignee, *Outboard Marine Corp.*

Hereby dedicates to the Public the entire term of said patent.

[*Official Gazette April 24, 1984.*]